United States Patent [19]

Bowden

[11] Patent Number: 4,787,294

[45] Date of Patent: Nov. 29, 1988

[54] SECTIONAL FLOW CONTROL AND LOAD CHECK ASSEMBLY

[75] Inventor: Charles J. Bowden, Battle Creek, Mich.

[73] Assignee: Hydreco, Incorporated, Kalamazoo, Mich.

[21] Appl. No.: 79,011

[22] Filed: Jul. 29, 1987

[51] Int. Cl.[4] ..... F15B 11/08

[52] U.S. Cl. ..... 91/447; 137/596

[58] Field of Search ..... 91/445, 446, 447, 462; 137/596.13, 596

[56] References Cited

U.S. PATENT DOCUMENTS 3,455,210 7/1969 Allen .
3,592,216 7/1971 McMillen .
4,088,151 5/1978 Schurger ..... 91/445 X
4,193,263 3/1980 Ille .
4,194,532 3/1980 Hall ..... 91/447 X
4,352,375 10/1985 Williams ..... 137/596.13
4,693,272 9/1987 Wilke ..... 137/596
4,697,498 10/1987 Yoshikawa et al. ..... 91/420

*Primary Examiner*—Edward K. Look
*Attorney, Agent, or Firm*—Barnes & Thornburg

[57] ABSTRACT

A flow control and load check valve in a spool valve between a first power core (20) and the motor ports (22,24,26) for controlling the flow therebetween as a function of the differential pressure of the first power core and the inlet pressure. A piston (66) responsive to said two pressure positions a sleeve (76) to determine the flow rate. The sleeve (76) also serves as a load check.

11 Claims, 4 Drawing Sheets

SECTIONAL FLOW CONTROL AND LOAD CHECK ASSEMBLY

The present invention relates generally to fluid directional control valves and, more specifically, to an improved flow control and load check assembly for use in a fluid directional control valve.

As is well-known, directional control valves or spool valves by themselves have not been entirely satisfactory to provide a constant metered flow of fluid to or from the fluid operated actuator. For example, with conventional spool valves, if the valve spools are positioned to provide a partial flow condition, a change in pressure will produce a change in the flow rate.

One solution to this problem is described in the Allen, U.S. Pat. No. 3,455,210. This patent provides a pressure-compensating valve 36 including a piston 48 whose position is determined by the differential pressure between the pressure from the pump and a signal from the motor ports from the directional control valve 14. The fluid flow from the pump is through the pressure compensating valve 36 to the inlet of the spool or directional control valve 14.

For the fluid control system including a plurality of spool valves, a flow control or bypass valve for the system as well as individual flow control valves for each directional valve have been provided as illustrated in U.S. Pat. No. 3,592,216 to McMillen. The main fluid pressure responsive means or bypass valve 18 is in the inlet section and at least one flow control valve 27 is shown with an individual directional valve 25 in section 14. As illustrated in FIG. 2 of the McMillen, the flow control valve 27*a* is constructed, as is the one from the Allen patent, mentioned above, wherein the pump pressure is on one side of the piston and operates against a pressure from the motor port of the bidirectional valve 25 to determine the flow from the pump to the inlet of the bidirectional valve through the flow control valve. As an improvement over Allen, the McMillen patent is structured such that the piston also acts as a load check when the pump pressure at the inlet of the flow control valve 27 is very low.

A further refinement to the McMillen patent is illustrated in the Ille patent, U.S. Pat. No. 4,193,263. As with the previous two patents, a piston is provided in the flow control valve to determine the flow from the pump to the inlet of the bidirectional valve as a function of the position of the piston whose position is determined by the differential pressure between the pump pressure on the inlet to the flow control valve and the motor port pressure of the bidirectional valve. The refinement of the Ille patent is that the load check is provided in the flow control valve as a separate and distinct element 96 from the piston of the flow control valve.

Although prior art systems have improved the fluid flow through bidirectional or spool valves in a metered condition, they have not been able to incorporate the flow compensation in the body of the directional control or spool valve. This has prevented the placement of the flow control valve between the variable restriction produced by the spool between the inlet of the spool valve and the motor port which is highly desirable.

An object of the present invention is to provide an improved flow control valve. Another object of the present invention is to provide improved combined flow control and load check valve. A still further object of the present invention is to provide a flow control and load check valve between the inlet port of a spool valve and its motor ports.

These and other objects are attained by a flow control valve having a piston in a bore between its inlet and outlet ports with a spring on the inlet port side of the piston to determine flow between the inlet and outlet ports as a function of the differential pressure between the inlet port and a reference port which provides pressure on the second surface of the piston opposite the inlet side. A movable member or sleeve on the inlet port side of the piston rides on the piston and is positioned to determine the interconnection of the inlet and outlet ports through the bore in which the piston and sleeve move as a function of differential pressure and which also provides a load check function, when the inlet pressure is below a predetermined value and the differential pressure is below a second predetermined value.

This improved structure may be incorporated in the body of the spool valve wherein the bore lies between the first and second power cores of the valve. A first power core is connected to the inlet core through the spool valve and communicates fluid from the first power core to the second power core depending upon the position of the piston and sleeve. By positioning the flow control valve between the first and second power core, it controls the flow past the restriction produced by the position of the spool valve. The other signal supplied to the other side of the piston is the inlet pressure upstream from the spool. The sleeve and the spring are provided on the first power core side of the piston.

Other objects, advantages and novel features of the present invention will become apparent from the following detailed description of the invention when considered in conjunction with the accompanying drawings.

DESCRIPTION OF THE PREFERRED EMBODIMENTS

Figure 1:
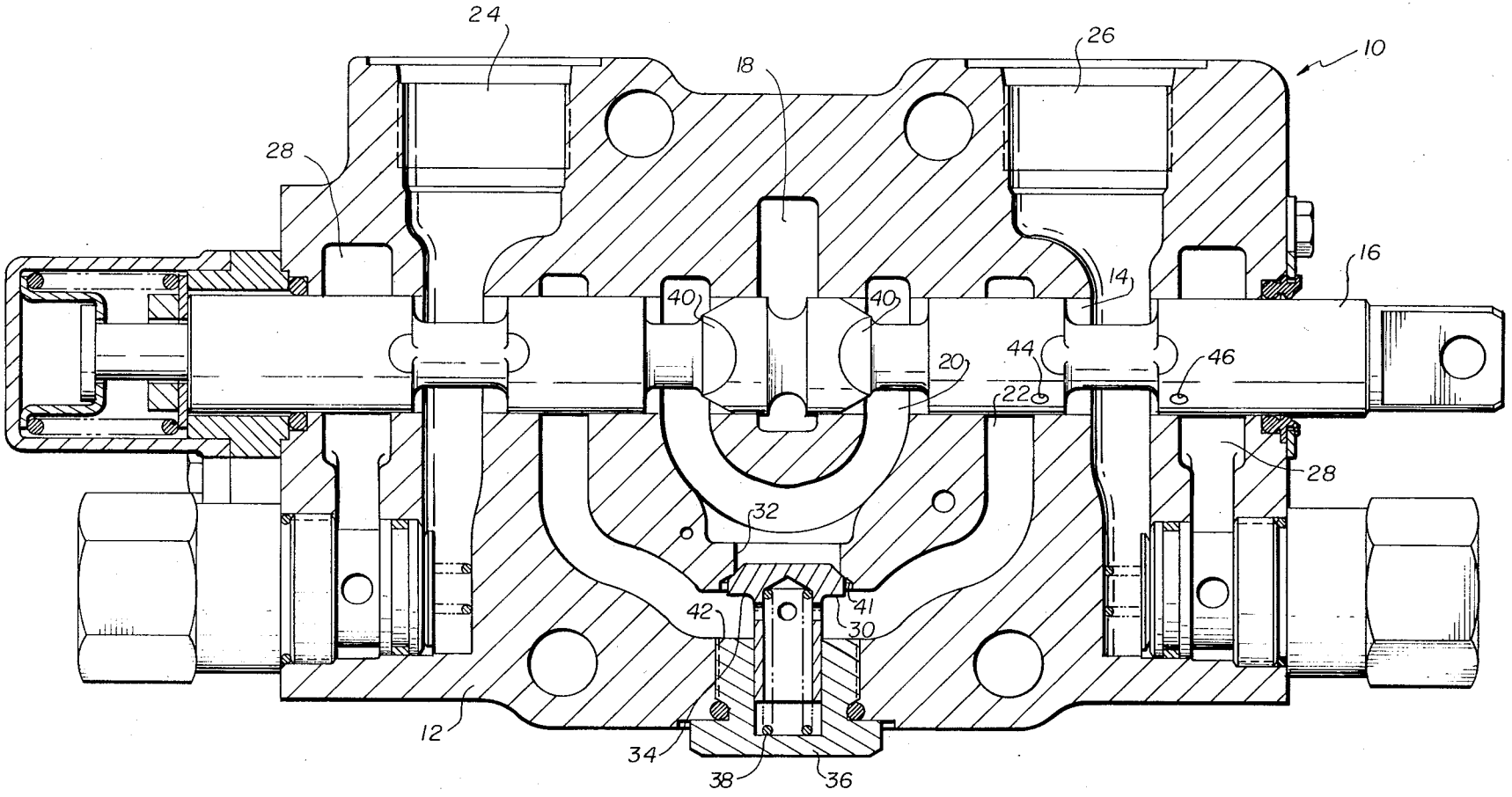
FIG. 1 PRIOR ART
FIG. 1 is a cross-sectional view of a spool valve including a load check therein of the prior art.

A double acting spool or directional control valve 10 of the prior art is illustrated in FIG. 1. The spool valve 10 includes a body 12 having a center bore 14 which receives the spool 16. The body 12 also includes an inlet or supply core 18, first and second power cores 20 and 22, respectively, first and second motor cores 24 and 26 and outlet core 28. A load check 30 is provided in a bore 32 between the first power core 20 and the second power core 22. Load check 30 includes a plunger 34 to seal off the bore 32 against seat 41, a stop and spring housing 36 received in bore 42 in the body 12 and a spring or biasing means 38 between the stop 36 and the plunger 34. When there is substantially no pressure in the first power port 20, the light spring 38 closes the interconnection between the first power core 20 and the second power core 22 to prevent fluid from flowing back into the inlet port.

This spool 16 is notched or chamfered at 40 between the inlet core 18 and the first power core 20 such that movement of the spool 16 will provide a metered flow therebetween. The spool 16 is illustrated in the neutral position wherein all of the cores are disconnected. Holes 44 and 46 provide a connection between the second power core 22 and the outlet core 28 which is usually connected to a reservoir such that the second power core 22 can be drained in the neutral position. In normal operation, the spool 16 is moved to the right or left to supply metered fluid flow from the inlet core 18 to the first power core 20. The pressure is great enough to move the load check 30 off the seat 41 to open bore 32 to allow communication to the second power core 22. Depending upon the position of the spool 16, the second power core 22 is connected to either the first motor core 24 or the second motor core 26. The other motor core is connected to its respective portion of the outlet or reservoir core 28. The remainder of the elements of the directional or spool valve 10 are not described since they play no part of the invention and are well-known to those in the art.

Figure 2:
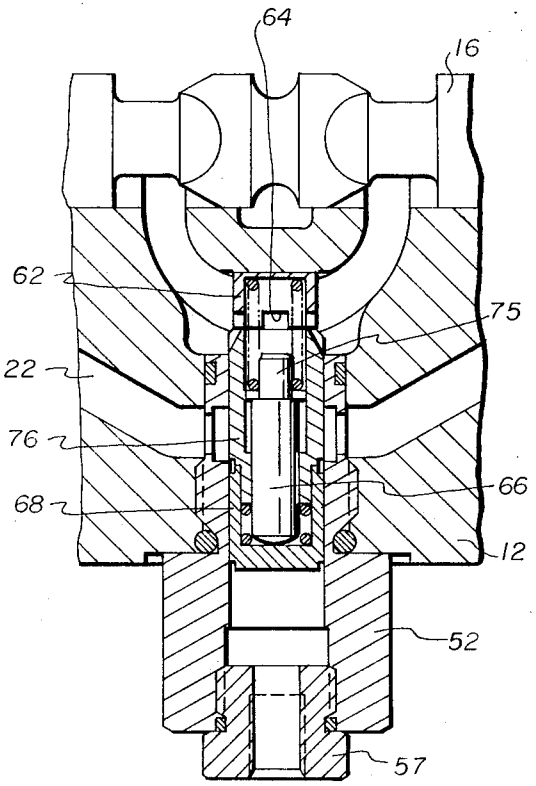

A flow control and load check valve assembly of the present invention is illustrated in FIG. 2 as 50 incorporated into the body 12 of the valve of FIG. 1. A cylindrical guide 52 is threadably received in bore 42 which previously held the stop 36 of the load check 30 and extends through the bore 32 which interconnects the first power core 20 and a second core 22. The diameter of the bore 32 has been increased and is indicated by the number 32'. O-ring gaskets 54 and 56 provide a seal between the body 12 and the guide 52. A center bore 58 through the guide 52 operates as the bore 32 in the valve of FIG. 1. A stop 57 is provided in the bottom of the bore 58 and includes an inlet bore 59 which receives a reference fluid pressure which is the pressure of the inlet port received from the supply or pump. In addition to widening the diameter of the bore 32, a flat surface 60 is provided in the first power core 20 along the axis of the bore 32 against which rests a combination stop and spring holder 62. The spring holder 62 includes a plurality of circumferentially spaced openings 64.

A piston 66, including a piston head 68 and a piston rod 70, is slidably received in the bore 58 of the guide 52. A spring 72 rests on a spacer 74 which is received on a reduced diameter portion 75 of the piston rod 70. The other end of the spring 72 is received in the stop and spring holder 62. The spring 72 biases the piston down in the bore 58. A sleeve 76 is received about piston rod 70 and includes flats (not shown) or other openings which vent or connect the area between the bottom of the sleeve 76 and the top of the piston head 68 to the second power port 22. The piston head 68 is cup-shaped and has an inside diameter larger than the outside diameter of the piston rod 70 so as to receive a light spring 78 which extends up to the bottom of the sleeve 76. The light spring 78 urges the sleeve 76 away from the piston head 68. The top edge of the sleeve 76 includes circumferentially spaced notches 80 therein to permit metered flow as will be explained more fully below, the sleeve 76 operates as a load check as well as a flow control determining device.

The operation of the flow control and load check valve will be explained with reference to FIG. 2–5. Under normal operating conditions and with the spool 16 in the neutral position, as illustrated in FIG. 2, the high pressure at reference port 59 overcomes the spring 72 and drives the piston assembly up until the sleeve 76 engages the top stop 62 depressing spring 72 and continuing on compressing spring 78 until the piston head 68 comes into contact with the bottom of the sleeve 76. In this position, the sleeve 76 blocks the connection of the second power core 22 to the bore 58 and to the first power core 20.

Figure 3:
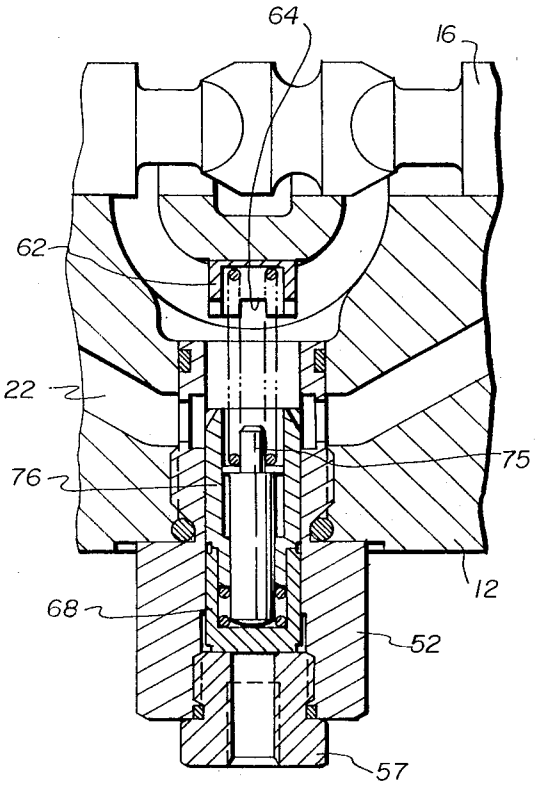
FIGS. 2–5 are partial cross-sectional views of the combined flow control and check load valve assembly incorporated into the spool valve of FIG. 1 in accordance with the principles of the present invention in various operating positions.

When the power spool 16 is moved to the right as illustrated in FIG. 3, or the left, the high pressure in the inlet core 18 is communicated with the first power core 20 flowing through opening 64 in the top stop 62 to drive the piston 66 down against the bottom stop 57. The pressure is also acting upon the sleeve 76 such that it travels with the piston 66. In the full position to the right, the inlet pressure 18 will flow freely into the first power core 20 such that the pressure on the top side of the piston 66 is substantially equal to that on the bottom side at port 59. Since the spring 72 aids the pressure on the first power core 20, the piston will start moving down and come to rest against the stop 57 for a pressure in the first power core 20 less than that at the reference port 59. This position is illustrated specifically in FIG. 3 wherein substantially all the pressure from the inlet core 18 is transmitted to the second power core 22 which in this case will be transmitted to the first motor port 24 on the left side of the body 12.

Figure 4:
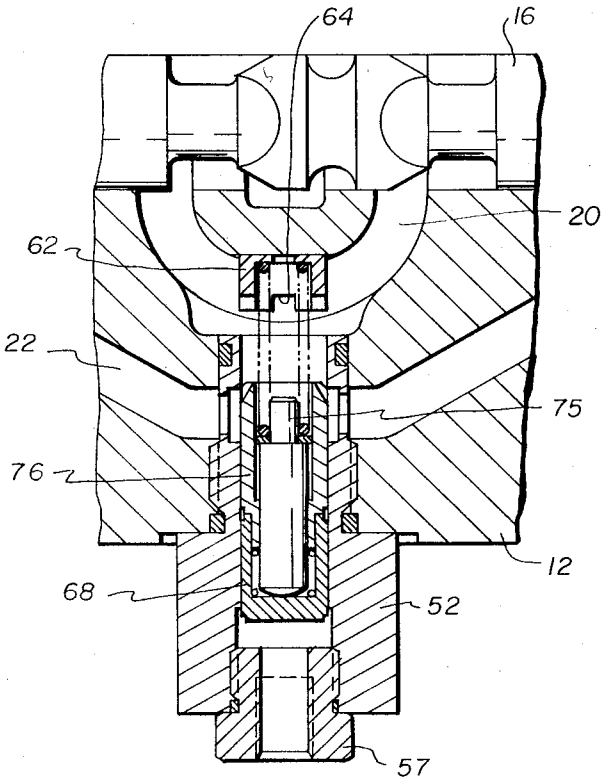

With the power spool 16 moved to less than a full position to the right, namely, a metered position, the pressure in the first power core 20 is substantially less than the inlet pressure which is available at the reference port 59 and in combination with spring 72 will not force the piston 68 and sleeve 76 all the way down against the stop 57. The sleeve 76 will remain engaging the piston head 68 but assumes a metering position in the bore restricting the flow from the first power core 20 through the bore 58 to the second power core 22 as illustrated in FIG. 4. By providing flow control valve between the first and second power cores, it is more directly responsive to the actual pressure available after the variable restriction produced by the power spool 16 between the inlet core 18 and the first power core 20. This improves the accuracy and the response time of the flow control element.

The flow control valve may also assume the position of FIG. 4 in response to a relatively light load in the device which are connected to the motor ports compared to inlet pressure. To be more specific, initially when the power spool 16 is opened, the elements are in the position illustrated in FIG. 2 except for the power spool, and a low differential pressure exists since the first power core 20 is exposed to the high pressure in the inlet core 18 which is substantially equal to that of the reference port 59. This will position the piston 66 and the sleeve 76 to the position of FIG. 3 against the stop 57. If the load is light, the pressure in the first power core 20 compared to inlet pressure will be dissipated into the second power core 22 creating a relatively large differential pressure across power spool 16 causing the piston 66 and the sleeve 76 to rise thereby metering or reducing the flow from the first power core 20 to the second power core 22. This allows the pressure in the first power core 20 to build up again until an equilibrium is reached wherein a specific position of the sleeve 76 above the bottom stop 57 defines the proper flow. Thus, the fluid flow to the second power core 22 and the motor port is approximately at the same speed as when there is a heavy load in the cylinder and the sleeve 76 is fully down allowing complete fluid flow.

Similarly, if the load should become heavy, the fluid flow will slow down, increasing the pressure in the first power core 20 compared to the inlet pressure and reducing the differential pressure across the power spool 16. This cause the piston 66 and the sleeve 76 to lower, increasing fluid flow from the first power core 20 to the second power core 22 to the desired flow before the load changed.

Figure 5:
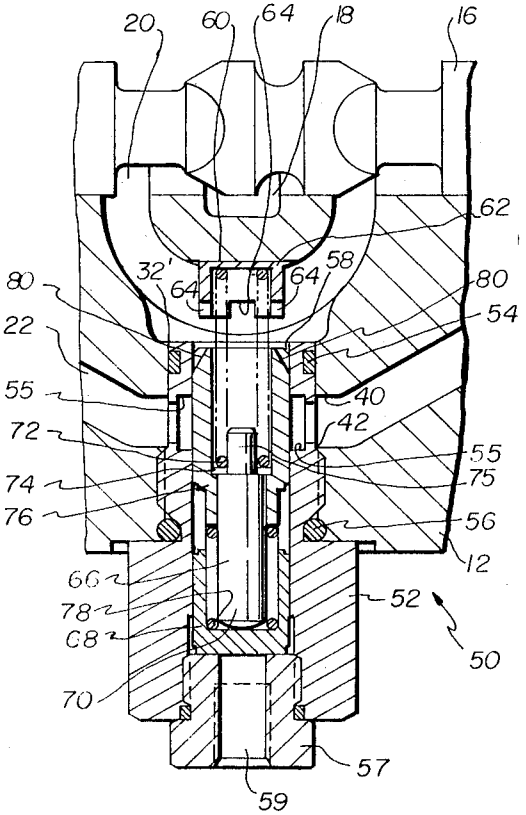

In the position illustrated in FIG. 5, the spool 16 is in a power position connecting the high pressure of the inlet core 18 to the first power core 20 and interconnecting the second power core 22 to the motor core 24 or 26. If the high pressure at the supply fails, no pressure is present at the reference port 59 on the bottom side of the piston 68 nor at the inlet core 18. The spring 72 keeps the piston 66 at the bottom of the bore 58 against stop 57. The spring 78 keeps the sleeve 76 up away from the piston head 68. It should be noted that spacer 74 acts as a stop for the sleeve 76 in it upmost position away from the piston head 68. In this position, the sleeve 76 acts as a load check disconnecting the second power core 22 from the bore 58 and the first power core 20 and preventing fluid from draining from the motor cores and the second power core 22. In this position, the pressure in the first power core 20 is less than the predetermined value which is the function of the light spring 78 and the differential pressure between the first power core 20 and the reference input 59 is below a predetermined value, namely that of the large spring 72.

Figure 6:
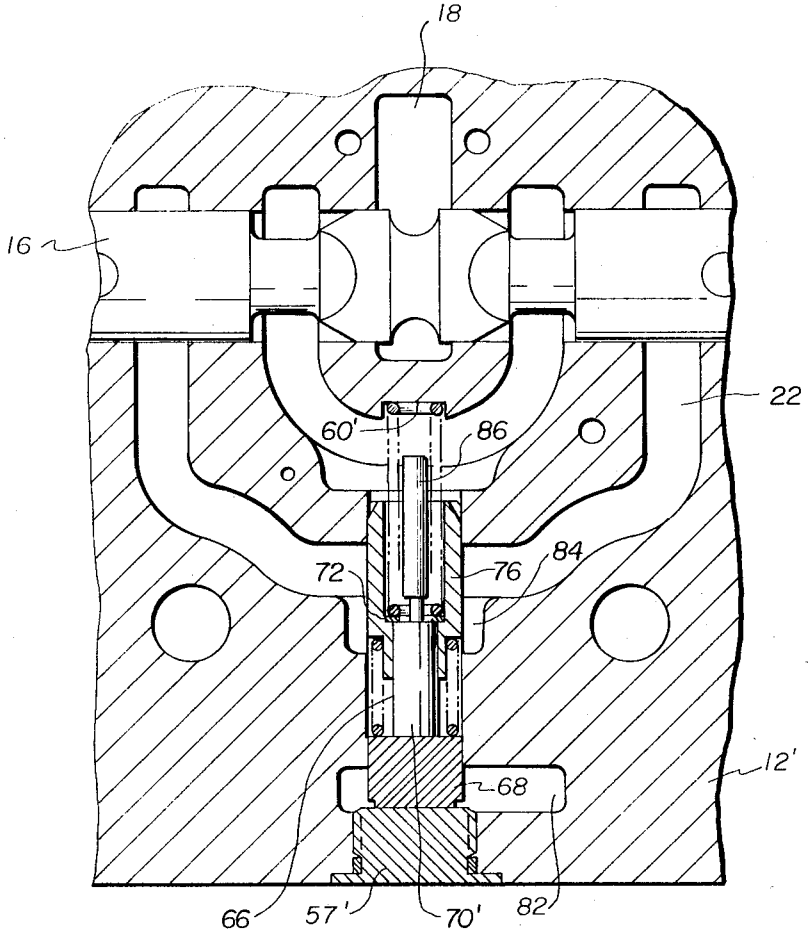
FIG. 6 is a partial cross-sectional view of the flow control and load check valve incorporated into a modified spool valve.

Although the combined flow control and load check valve of the present invention has been described in FIG. 2–5 as being retrofitted to an existing valve structure with minor modifications to produce the flat surface 60' and enlarge the center bore 32, a newly designed valve may also be provided and is illustrated in FIG. 6. In this instance the body 12' is enlarged to provide the equivalent of the guide 52 having the stop 57' threadably received therein. A bore 82 which communicates with the bottom surface of the piston head 68 is connected internal the body 12 to the inlet core 18. This removes the requirement of an external connection and a reference port 59 in . the bottom stop 57'. Also, a core 84 provides fluid communication between second power core 22 and the piston head 68 and thus the sleeve 76 need not include flats. The head of the piston rod 70' has been shortened to just extend beyond spacer 72. The stop and spring holder 62 has been deleted and the flat 60 is shown as a bore 60' which acts as a spring holder. The stop function is performed by a rod 86 extending between the piston rod 70' and the bottom of bore 60. This modification may also be incorporated in the embodiment of FIGS. 2–5 and is preferred since it eliminates a specially machined piece 62 and does not restrict the flow in the first power core 20.

Although the combined flow control and check has been illustrated as being incorporated the cores of a spool valve, the structure and are considered an improvement over prior combined flow control and load check valves and, thus, may also be built in their own housing and be part of other fluid circuits. As distinguishable from the prior art, the inlet receives a variable fluid signal which is provided to the outlet. The reference signal is a fixed signal from the supply. The pressure differential spring is on the inlet side of the piston structure. A load check structure, which interacts with the flow control piston, is also on the inlet side of the structure.

Figure 7:
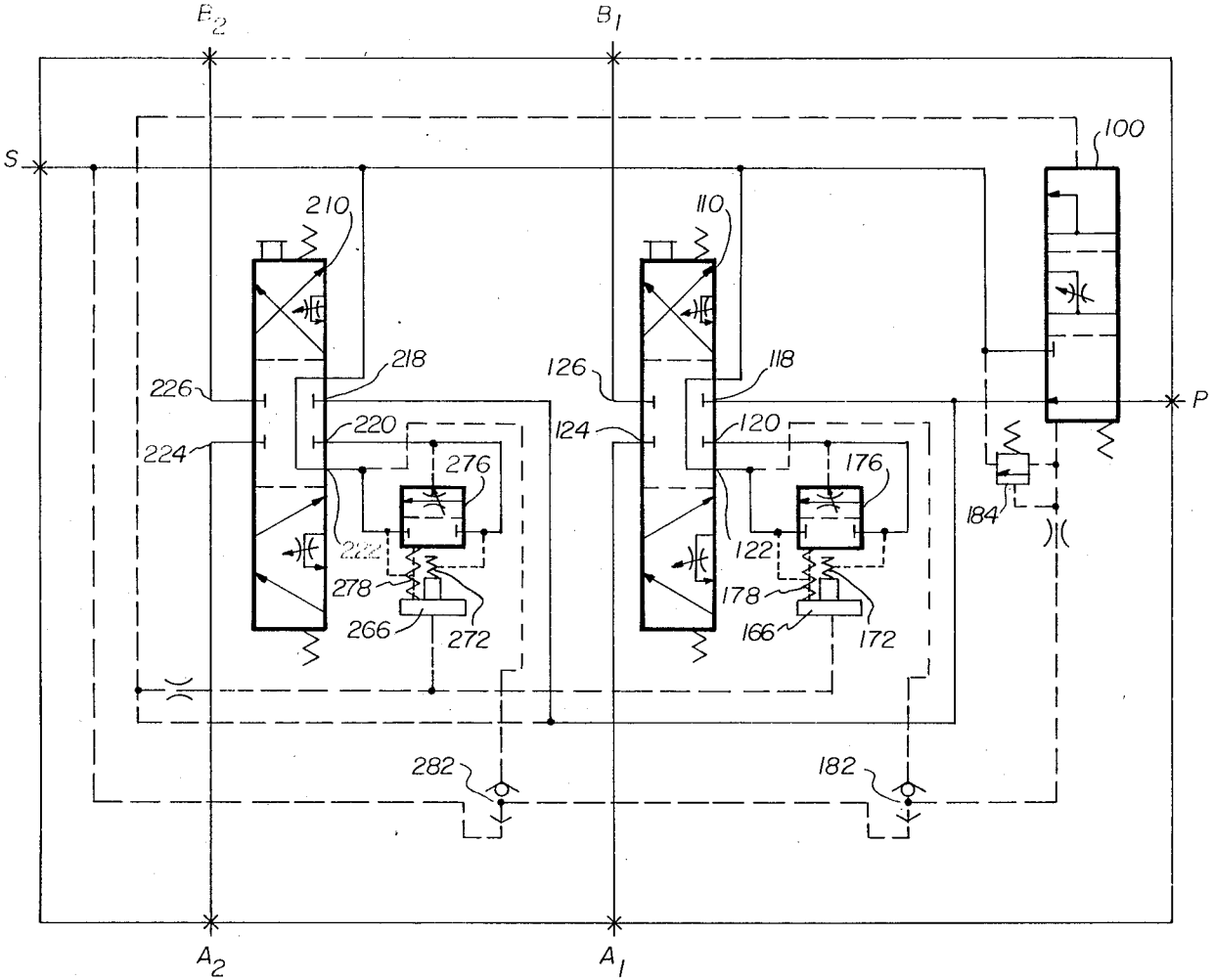
FIG. 7 is a schematic of fluid system incorporating the improved spool valve having a flow control and a load check valve incorporated therein according to the principles of the present invention.

FIG. 7 shows schematically the combined flow control and load check valve incorporated into the body of two parallel connected spool valves. The pump P is connected through a system flow control or dumping valve 100 to inlet 118 of valve 110 and inlet 218 of valve 210. The first power cores 120 and 220 are respectively connected to the inlet of the internal flow control and load check valve 176 and 276, respectively. The outlet of the flow control and load check valve 176 and 276 are connected to the second power cores 122 and 222, respectively. Motor ports 124, 224, and 126, 226 are shown extending from the valves 110 and 210, respectively.

The dotted line between the first power cores 120, 220 and the flow control valves 176 and 276 represents the pressure signal in the first power cores. This is opposed by the dotted line on the pistons 166, 266 which can be traced to the line from the pump P to the inlet ports 118, 218. A dotted line is also shown as a pressure signal from the first power core 120, 220 operating in combination with springs 172, 272 on the piston 166, 266 against the pressure from the pump P. Springs 178, 278 of the load check are shown between the pistons 166, 266 and the sleeves 176, 276 and a dotted line is shown as connecting or venting the area between pistons 166, 266 and sleeve 176, 276 to the second power cores 122, 222. Logic elements 182, 282 are connected to the power ports 122, 222 to provide a control signal back to the system flow control valve 100. The logic elements 182, 282 select the higher of the two pressures to be used as the control signal for the valve 100. A pressure release valve 184 connects the control signal's side of the valve 100 to the pump S. As can be noted from the schematic, the flow control valves 176, 276 are shown as being downstream of the variable restriction produced by the spool of the valves 110, 210.

From the preceding description of the preferred embodiments, it will be evident that the objects of the invention are attained in that an improved flow control valve is provided internal a spool valve structure. Although the invention has been described and illustrated in detail, it is clearly understood that the same is by way of illustration and example only and is not to be taken by way of limitation. The spirit and scope of the present invention is limited only by the terms of the appended claims.

I claim:

1. In a control valve including a body, an inlet port, an outlet port, a first and second motor ports, an inlet core connected to said inlet port, a first and a second power core, a load check means in a bore connecting said first and second power cores, first and second motor cores connected to a respective first and second motor port, an outlet core connected to said outlet port and a spool means for determining the interconnections of said inlet core to said first power core of said second power core to said motor cores and of said motor cores, to said outlet core, the improvement comprising:

a flow control means in said bore between said first and second power cores and being connected to said inlet port for controlling the fluid flow from said first to said second power core as a function of the differential of the inlet port pressure and said first power core pressure.

2. A control valve according to claim 1, wherein said flow control means includes a piston slidably mounted in said bore and said load check means riding on said piston.

3. A control valve according to claim 2, wherein said load check means includes a movable member for closing off the interconnection of said first and second power cores through said bore and biasing means for urging said movable member away from said piston to close said interconnection through said bore.

4. The valve according to claim 3, wherein said flow control means includes a biasing means for urging said piston against said inlet port pressure.

5. The valve according to claim 2, wherein said load check means includes a movable member having a first position in said bore restricting the connection of said first power core to said bore and closing the connection of said bore to said second power core, a second position closing the connection of said bore to said second power core and a third position defining the fluid flow from said bore to said second power core.

6. The valve according to claim 5, wherein said piston having a first and second position in said bore, said movable member in its first position engages said piston in its first position, said movable member in its third position engages said piston in its second position, and said movable member in its second position is displaced from said piston in its second position.

7. The valve according to claim 6 including a pair of stop means in said bore, one of said stop means defining said first position of said movable member and of said piston and the other of said stop means defining said second position of said piston.

8. The valve according to claim 6, wherein said movable member has a plurality of positions between said second and said third position and said piston has a corresponding plurality of positions between said first and second position for defining a plurality of flow rates from said bore to said second power core.

9. The valve according to claim 1, wherein said load check means includes a movable member for closing the interconnection of first and second power cores for a pressure in said first power core less than a first predetermined valve, and said flow control means includes a piston in said bore and engaging said movable member for positioning said movable member in said bore as a function of the differential of said inlet pressure and said first power port pressure to define the fluid flow from said first power core to said second power core.

10. The valve according to claim 9, wherein said load check means includes a spring means between said movable member and said piston and having a spring constant to define said first predetermined value of pressure.

11. The valve according to claim 10, wherein said flow control means includes a spring means on the first power core side of said piston for defining the pressure differential at which there is unrestricted flow.

* * * * *